US009206670B2

(12) United States Patent
Webber et al.

(10) Patent No.: US 9,206,670 B2
(45) Date of Patent: Dec. 8, 2015

(54) INDEPENDENT DUAL ACTUATED SUBSURFACE SAFETY VALVE

(71) Applicant: Halliburton Energy Services, Inc., Houston, TX (US)

(72) Inventors: Andrew John Webber, Coppell, TX (US); Frank David Kalb, Lantana, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 583 days.

(21) Appl. No.: 13/632,347

(22) Filed: Oct. 1, 2012

(65) Prior Publication Data

US 2013/0092396 A1 Apr. 18, 2013

(51) Int. Cl.
*E21B 34/10* (2006.01)
*E21B 34/00* (2006.01)

(52) U.S. Cl.
CPC ..... *E21B 34/10* (2013.01); *E21B 2034/005* (2013.01)

(58) Field of Classification Search
CPC ..... E21B 34/10; E21B 2034/005
See application file for complete search history.

(56) References Cited

U.S. PATENT DOCUMENTS 4,161,219 A 7/1979 Pringle
4,838,355 A 6/1989 Leismer et al.
4,976,317 A 12/1990 Leismer
5,167,284 A 12/1992 Leismer
5,343,955 A 9/1994 Williams
7,762,335 B2 7/2010 Anderson et al.
8,616,291 B2 * 12/2013 Smith et al. ..... 166/375

OTHER PUBLICATIONS

PCT International Preliminary Report on Patentability, PCT/US2011/055960, Apr. 24, 2014, 7 pages.
Notification of Transmittal of the International Search Report and the Written Opinion of the International Searching Authority, or Declaration (2 pages); International Search Report (4 pages); and Written Opinion of the International Searching Authority (5 pages), mailed Jun. 29, 2012, for related international application PCT/US2011/055960.

* cited by examiner

*Primary Examiner* — David Andrews
(74) *Attorney, Agent, or Firm* — Scott Richardson; Fish & Richardson P.C.

(57) ABSTRACT

A downhole valve for use in a well has a closure device that is biased closed to seal against flow through the central bore of the valve. A plurality of pistons are each coupled to a respective hydraulic control line into the valve. Each piston is adapted to reside in an actuated position, supporting the closure open, when at least a specified hydraulic pressure is supplied through its control line, and to reside in an unactuated position, not supporting the closure open, when at least the specified hydraulic pressure is not present in its control line. The valve has a chamber containing a hydraulic fluid hydraulically coupling the pistons to support any piston not receiving the specified hydraulic pressure in an unactuated position. In certain aspects, when the piston is in the unactuated position, it seals against communication of fluid with its respective control line using a static-type seal.

19 Claims, 12 Drawing Sheets

INDEPENDENT DUAL ACTUATED SUBSURFACE SAFETY VALVE

BACKGROUND

In many instances, a well includes a subsurface safety valve for controlling fluid flow, such as closing the well. The valve is typically designed to failsafe to automatically shut the well in if the hydraulic control line to the valve loses the hydraulic pressure. However, such failsafe mechanism may not distinguish a purposeful shut-in operation from a leak incident that causes a pressure drop in the control line.

SUMMARY

The current disclosure relates to surface controlled valves for controlling fluid flow in a well, including those configured as subsurface control valves. In a general aspect, an independent dual actuated subsurface safety valve is controlled by two independent control systems that can independently actuate the valve. In the event of one of the control systems failing, the other control system can be utilized to maintain full functional control of the valve.

One aspect encompasses a subsurface safety valve for use in a subterranean well. The valve includes a tubular body defining a flow bore therethrough. A closure is in the tubular body and is changeable between sealing against flow through the flow bore and allowing flow through the flow bore. The valve has a first piston with a first control line inlet arranged to receive a first control pressure from a first control line. The first piston is movable from a first unactuated position to a first actuated position in response to the first control pressure. The valve has a second piston with a second control line inlet arranged to receive a second control pressure from a second control line. The second piston is moveable from a second unactuated position to a second actuated position in response to the second control pressure. The first and second pistons are coupled to the closure to change the closure between sealing against flow through the flow bore and allowing flow through the flow bore when the first and second pistons are respectively moved to the first and second actuated positions. The first and second pistons are hydraulically coupled to one another to support the first piston in an unactuated state when the second control pressure applied to the second piston is greater than an actuation pressure and the first control pressure applied to the first piston is less than the actuation pressure. In certain aspects, the first and second pistons are hydraulically coupled to one another to support the second piston in an unactuated state when the first control pressure applied to the first piston is greater than the actuation pressure and the second control pressure applied to the second piston is less than the actuation pressure. In certain aspects, the first piston has a static-type seal that seals against flow into the first control line when the first piston is in the first unactuated position and the first piston comprises a static-type seal that seals against flow into the first control line when the first piston is in the first actuated position.

One aspect encompasses a method of operating a downhole valve. In the method actuation pressure from a first control line is received at a first piston and actuation pressure from a second control line is received at a second piston. In response to the actuation pressure, a flow bore closure of the valve is actuated open using the first and second pistons. A reduced pressure, below the actuation pressure, is received from the second control line at the second piston. In response to the reduced pressure, the second piston is supported with a hydraulic pressure created by the first piston. In certain aspects, the second piston is supported to engage a static-type seal against passage of fluid with the second control line. In certain aspects, in response to the actuation pressure, the first piston is moved to engage a static-type seal against passage of fluid with the first control line.

One aspect encompasses a downhole valve for use in a well. The valve has a closure device in a central bore of the valve. The closure device is biased closed to seal against flow through the central bore. A plurality of pistons are each coupled to a respective hydraulic control line into the valve. Each piston is adapted to reside in an actuated position, supporting the closure open, when at least a specified hydraulic pressure is supplied through its control line, and to reside in an unactuated position, not supporting the closure open, when at least the specified hydraulic pressure is not present in its control line. The valve has a chamber containing a hydraulic fluid hydraulically coupling the pistons to support any piston not receiving at least the specified hydraulic pressure in an unactuated position. In certain aspects, when the piston is in the unactuated position, it seals against communication of fluid with its respective control line using a static-type seal.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
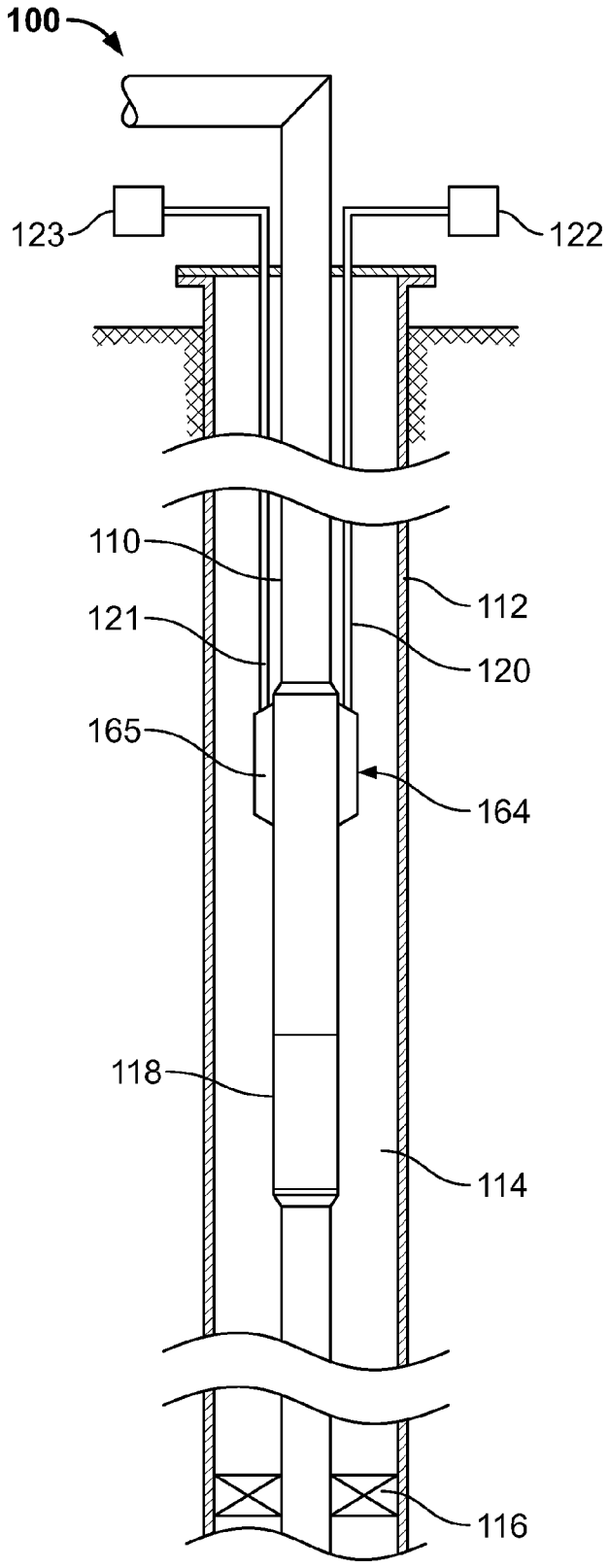
FIG. 1 is a schematic illustration of a well having an example independent dual actuated surface controlled subsurface safety valve.

FIG. 1 is a schematic illustration of a well 100 having an independent dual actuated surface controlled subsurface safety valve 118. The well 100 has a tubing string 110, such as a production and/or injection string, that passes fluids between a subterranean zone of interest and the surface. The well 100 may be cased with a casing 112, and together with the tubing string 110, form an annulus 114 therebetween. A seal, such as a packer 116, may be used to seal off the annulus 114 at a subsurface location above the subterranean zone.

The subsurface safety valve 118 is coupled with control line 120 and control line 121 respectively via control line interface 164 and control line interface 165. The control lines 120 and 121 may be hydraulic tubing and pass hydraulic fluids respectively from control systems 122 and 123 on the surface.

As illustrated in FIG. 1, the control systems 122 and 123 are two independently powered, and separately located hydraulic control systems that may apply hydraulic pressure to the subsurface safety valve 118 independently. However, in some embodiments, the control systems 122 and 123 may be two different outputs from a common hydraulic control system that achieves similar function as two independent and separated hydraulic power sources. The control systems 122 and 123 supply two separate control pressures to the valve 118.

The valve 118 is configured with two separate, independently controlled and redundant actuation systems. In certain instances, the actuation systems can have the same operating characteristics and/or can be of the same physical configuration (although, in some instances, mirror images of one another). One actuation system is coupled to communicate with the control system 122 via control line 120, and the other actuation system is coupled to communicate with the control system 123 via control line 121. The valve 118 is biased to default to a closed position, sealing against flow therethrough and through the tubing string 110. In other words, the valve 118 is configured to fail safe to closed. However, while receiving control pressure from both of the control systems 122 and 123, the two actuation systems maintain the valve 118 open, allowing passage of flow therethrough and through the tubing string 110. If the valve loses control pressure from both of the control systems 122 and 123, for example if the control system 122 and 123 are changed to cease providing pressure or if the control lines 120 and 121 are leaking or ruptured, the actuation systems no longer maintain the valve 118 open and it defaults closed. Notably, if the valve loses control pressure from one but not the other of the control system 122 and 123, the actuation system receiving pressure retains full function and will maintain the valve 118 open. The valve 118 is configured to positively seal off the hydraulic passages coupled to the leaking or ruptured control line to prevent leakage of hydraulic fluid and/or other fluids from inside the valve 118 into the annulus 114.

Figure 2:
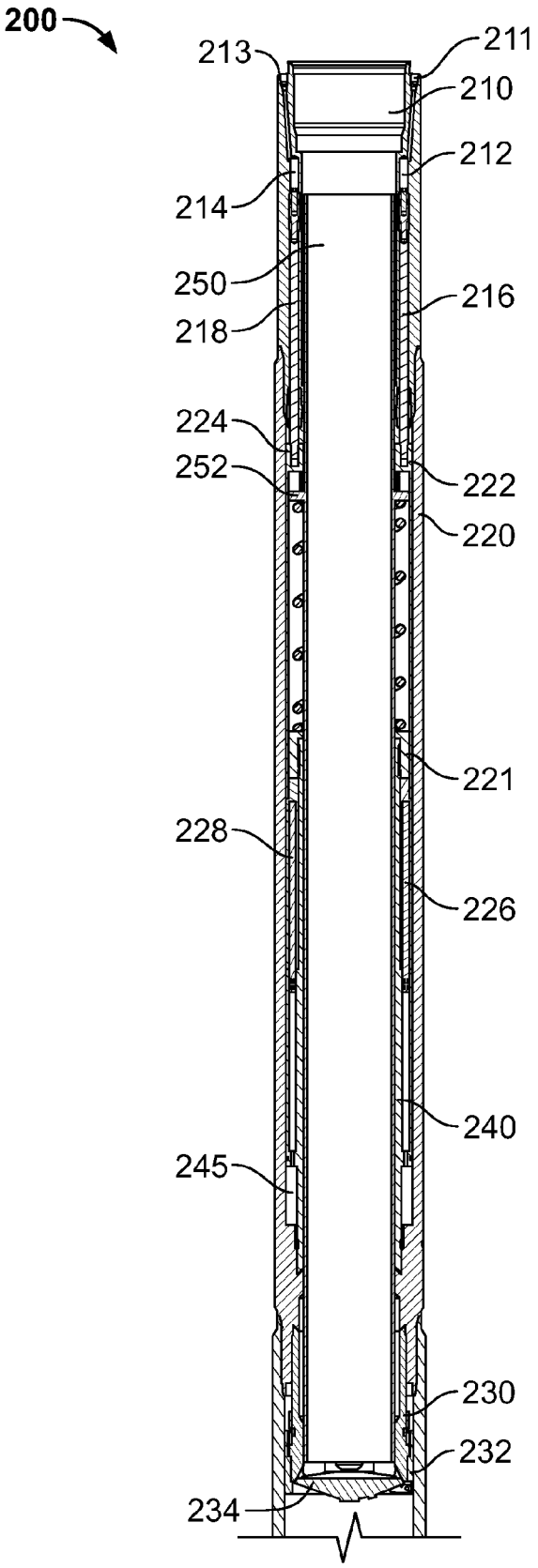
FIG. 2 is a half, side cross sectional view of an example independent dual actuated subsurface safety valve in an unactuated position.

FIG. 2 is a half, side cross sectional view of an example independent dual actuated subsurface safety valve 200 in an unactuated position. The subsurface safety valve 200 may be used as the subsurface safety valve 118 in FIG. 1. In this embodiment, the subsurface safety valve 200 includes a housing, actuation components, a flow tube 250 and a flapper 234. The actuation components operate the flow tube 250, which in an actuated position, pushes open the flapper 234 for flow to pass through, and in an unactuated position, remains inside the housing with the flapper 234 shut to seal against flow through the flow tube 250.

The housing includes a piston housing 210, a spring housing 220, an intermix piston mandrel 240, and a flapper seat assembly which includes an inner flapper seat 230 and an outer flapper carrier 232. The spring housing 220 connects to the piston housing 210 at the upper end and the flapper seat assembly at the lower end to form one integral assembly. The intermix piston mandrel 240 is installed inside the spring housing 220.

The piston housing 210 encloses actuator piston assemblies which react to control pressure to actuate the flow tube 250 from the unactuated to the actuated position to open the flapper 234. The piston housing 210 includes two control passages for connection to two control lines: control passage 212 and control passage 214. The control passages 212 and 214, respectively extended from two control line inlets 211 and 213, are connected to the two symmetrical and separate actuation systems which receive actuation hydraulic pressure from these two control passages 212 and 214. As is discussed in more detail below, the fluid from the control passage 212 and 214 is not comingled within the valve. Further, the symmetrical actuation systems can be configured to have similar, or identical, operational characteristics in actuating the valve. The control passages 212 and 214 receive pressure from control lines to the surface (e.g., control lines 120, 121).

An actuator piston rod 216 of one actuation system is coupled with the control passage 212 on its upper end and coupled with a split actuator sleeve 222 of the same actuation system on its lower end. Symmetrically, an actuator piston rod 218 of a second actuation system is coupled with the control passage 214 on its upper end and coupled with a split actuator sleeve 224 of the second actuation system on its lower end. The split actuator sleeves 222 and 224 engage the flow tube 250 (via a spring 450, discussed below) at the actuation flange 252 of the flow tube 250 and simultaneously couple with an intermix piston rod 226 of the first actuation system (via a sleeve 482, discussed below) and an intermix piston rod 228 of the second actuation system (via a sleeve 484, discussed below) respectively. The intermix piston rod 226 and the intermix piston rod 228 are hydraulically interactive via an intermix annular chamber 245 created between the intermix piston mandrel 240 and the spring housing 220.

At an unactuated position as shown in FIG. 2, the flow tube 250 is refracted within the spring housing 220 by a spring force exerted by a power spring 225, which pushes the flow tube 250 at the actuation flange 252 and is installed at a spring stop and bearing base 221 affixed to the spring housing 220. The undeformed length of the power spring 225 is longer than the allowable length after assembly, therefore a pre-stressed compressive force of the power spring 225 continuously pushes the flow tube 250 upwards. The compressive force is greater than the sum of resultant forces of the gravitational force of the flow tube 250 and friction forces, at full extension in the assembly.

The power spring 225, shown here as a metallic coil spring, may be any elastic object capable of storing mechanical energy when longitudinally deformed. The force the power spring 225 exerts may be proportional to its change in length: the spring constant of the power spring 225 is then the change in the force it exerts divided by the change in deflection.

The flapper assembly at the end of the housing includes the flapper seat assembly and a flapper 234. When unactuated, the flapper 234 is forced against the flapper seat assembly by a torsional spring, as well as the pressure of well fluids. The flapper 234 seals to the inner flapper seat 230. The seal closes the subsurface safety valve 200. Because the flow tube 250 is biased by the spring in an unactuated state, the valve is biased, fail safe closed. Also, although described in connection with a flapper 234 as the closure mechanism, the valve could alternately be configured with a ball valve type closure mechanism.

Figure 3A:
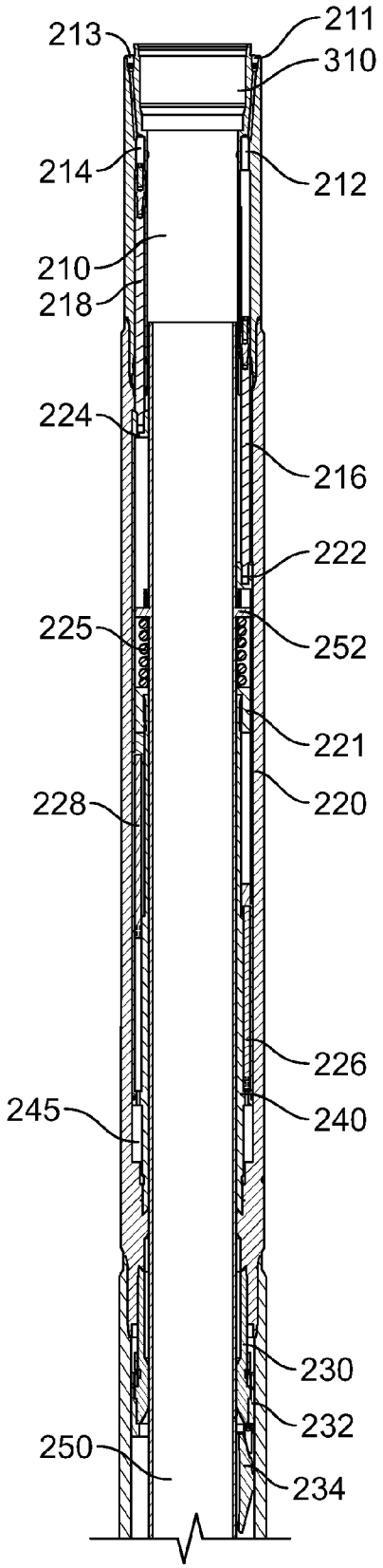
FIGS. 3A and 3B are half, side cross sectional views of the subsurface safety valve of FIG. 2 in each of the actuated positions.
Figure 3B:
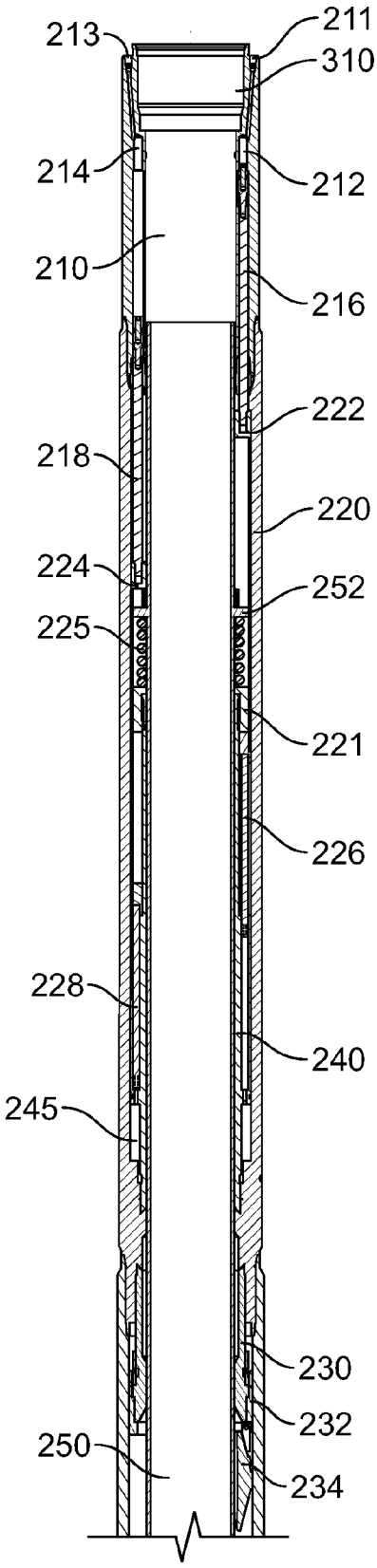

FIGS. 3A and 3B are half, side cross sectional views of the subsurface safety valve 200 in each of the actuated positions.

In FIG. 3A, the actuator piston rod 216 is actuated, pushing the flow tube 250 down to open the flapper 234 and via a hydraulic mechanism, pushing the actuator piston rod 218 to seal the control line 214, for example, using a metal-to-metal seal, an elastomer seal, etc. Similarly and symmetrically, in FIG. 3B, the actuator piston rod 218 is actuated, pushing the flow tube 250 down to open the flapper 234 and via the hydraulic mechanism, pushing the actuator piston rod 216 to seal the control line 212 using, for example, using a metal-to-metal seal, an elastomer seal, etc.

In FIGS. 3A and 3B, the piston housing 210 may be connected to a tubing string such as the tubing string 110 in FIG. 1 by the piston housing inner thread 310.

In the implementation in FIG. 3A, the control line 212 is pressurized to actuate the actuator piston rod 216 to push the flow tube 250 at the actuation flange 252, compressing the power spring 225 and translating the intermix piston rod 226 downwards, connected via the split actuator sleeve 222. The downward translation motion of the intermix piston rod 226 forces the intermix piston rod 226 to reach a sealing position at the end of the travel and applies pressure to the hydraulic fluid in the intermix annular chamber 245, which is formed by the enclosure between the intermix piston mandrel 240 and the spring housing 220. The hydraulic fluid in correspondence pushes the intermix piston rod 228 upwards, and consequently via the connection through the split actuator sleeve 224, the actuator piston rod 218 upwards to achieve a seal against the control passage 214.

The downward translation motion of the intermix piston rod 226 also pushes the flow tube 250 synchronously downward and opens the flapper 234 to an approximately perpendicular position relative to its closed position. The movement of the flow tube 250 compresses the power spring 225 that is constrained between the actuation flange 252 and the spring stop and bearing base 221. The compressed power spring 225 stores the elastic potential energy needed to return the flow tube 250 to the unactuated position and allows the flapper 234 to be closed.

Similarly, in the implementation in FIG. 3B, the control line 214 is pressurized to actuate the actuator piston rod 218 to push the flow tube 250 at the actuation flange 252, compressing the power spring 225 and translating the intermix piston rod 228 downwards, connected via the split actuator sleeve 224. The downward translation motion of the intermix piston rod 228 forces the intermix piston rod 228 to reach a sealing position at the end of the travel and applies pressure to the hydraulic fluid in the intermix annular chamber 245. The hydraulic fluid in correspondence pushes the intermix piston rod 226 upwards, and consequently via the connection through the split actuator sleeve 222, pushes the actuator piston rod 216 upwards to achieve a seal against the control passage 212.

The downward translation motion of the intermix piston rod 228 also pushes the flow tube 250 synchronously downward and opens the flapper 234 to a perpendicular position relative to its closed position. The movement of the flow tube 250 compresses the power spring 225 that is constrained between the actuation flange 252 and the spring stop and bearing base 221. The compressed power spring 225 stores the elastic potential energy needed to return the flow tube 250 to the unactuated position and allows the flapper 234 to be closed.

Figure 3C:
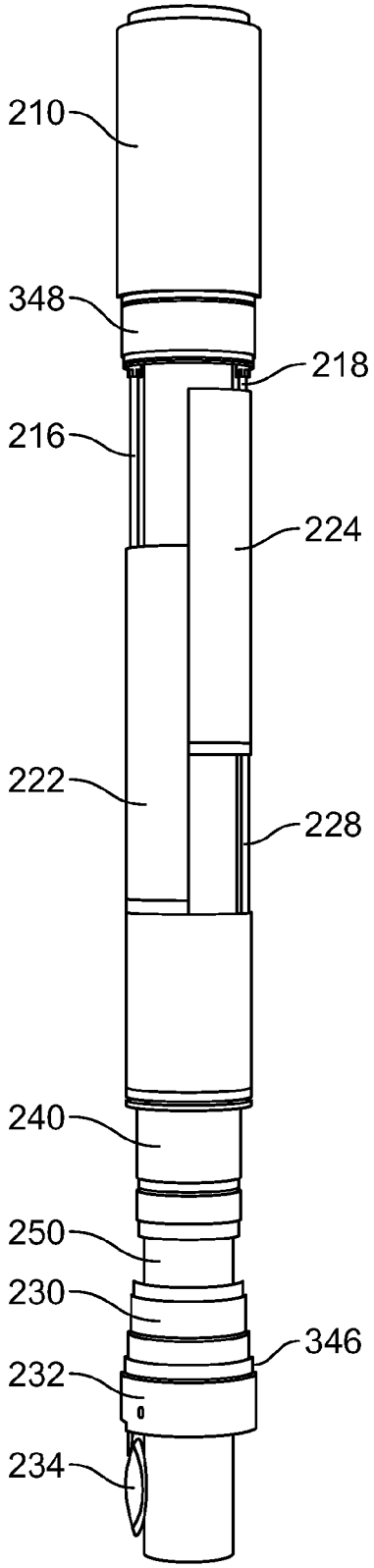
FIG. 3C is a side view of the subsurface safety valve of FIG. 2 in an actuated position with its spring housing omitted to show features of the valve.

FIG. 3C is a side view of the subsurface safety valve 200 in an actuated position with its spring housing 220 omitted to show features of the valve. FIG. 3C is showing the view from the back side of FIG. 3A. For example, the housing is integrated by a threaded connection 348 at the piston housing and flapper seat. The split actuator sleeves 222 and 224 conform to the size and shape of the spring housing 220, as a half cylindrical shape with a thickness giving enough strength for their function. FIG. 3C also shows the actuator piston rod 216 at an actuated position, pushing the split actuator sleeve 222 downwards and the split actuator sleeve 224 upwards.

In FIG. 3C, the flow tube 250 is translated downwards to open the flapper 234. The control line 212 is pressurized to actuate the actuator piston rod 216 to push the flow tube 250 at the actuation flange 252, compressing the power spring 225 and translating the intermix piston rod 226 downwards, connected via the split actuator sleeve 222. The downward translation motion of the intermix piston rod 226 forces the intermix piston rod 226 to reach a sealing position at the end of the travel and compresses the hydraulic fluid in the intermix annular chamber 245, which is formed by the enclosure between the intermix piston mandrel 240 and the spring housing 220. The hydraulic fluid in correspondence pushes the intermix piston rod 228 upwards, and consequently the actuator piston rod 218 upwards to achieve a seal against the control passage 214.

The inner flapper seat thread 350 locates at the upper end of the inner flapper seat 230 and couples with the spring housing 220 to seal the well fluid against the flow tube 250 and the intermix annular chamber 245. It is also shown in FIG. 3C that the inner flapper seat 230 is coupled with the outer flapper carrier 232 via a flapper seat joint 346.

Figure 4A:
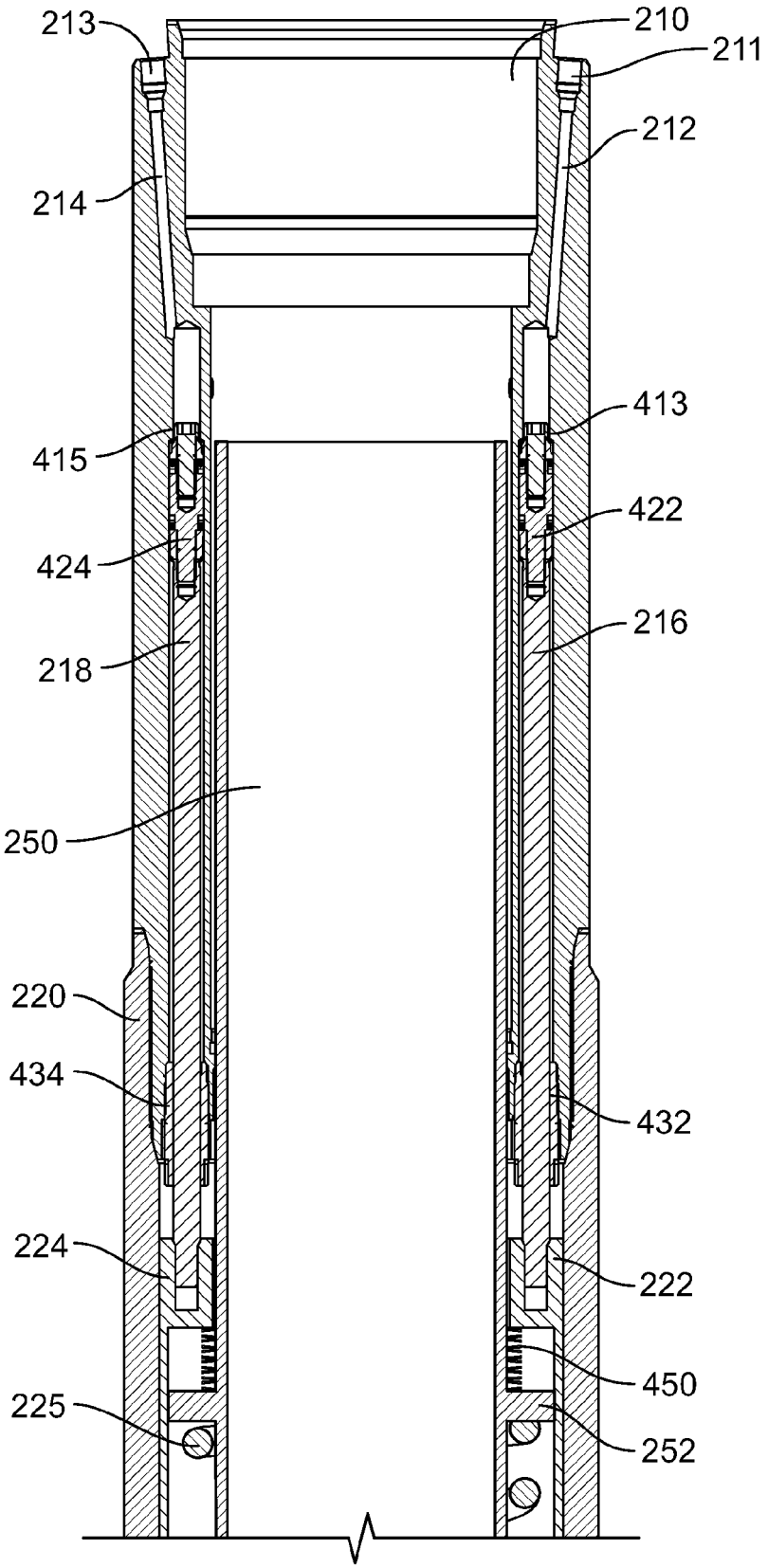
FIG. 4A is a detail half, side cross sectional view of the subsurface safety valve of FIG. 2 in the unactuated position showing details of actuator piston sealing assemblies.

FIG. 4A is a detail half, side cross sectional view of the subsurface safety valve 200 in the unactuated position showing details of actuator piston sealing assemblies 422 and 424. The subsurface safety valve 200 is sealed against well fluid with sealing forces provided by the power spring 225 pushing against the actuation flange 252 of the flow tube 250. The actuation flange 252 presses against a spring 450 which is coupled with both of the split actuator sleeves 222 and 224. The split actuator sleeves 222 and 224 are respectively coupled with the actuator piston rod 216 and the actuator piston rod 218. The actuator piston rods 216 and 218 are respectively connected with piston assemblies 422 and 424 that include seals (e.g., using a metal-to-metal seal, an elastomer seal, etc.) for sealing against control passages 212 and 214 respectively.

The spring 450, shown here as a plurality of Belleville washer springs, may be any elastic object capable of storing mechanical energy when longitudinally deformed. The force the spring 450 exerts may be proportional to its change in length. The spring constant of the spring 450 may be the change in the force it exerts divided by the change in deflection.

With the piston assemblies 422 and 424 in unactuated positions, the power spring 225 transmits compression forces through the flow tube 250, the spring 450, the split actuator sleeves 222 and 224, and the actuator piston rods 216 and 218, to the piston assemblies 422 and 424 to respectively seal against the upper sealing seats 413 and 415 of the control passages 212 and 214. As will become apparent from the discussion below, the forces from the power spring 225 are further supplemented by forces from pressure in the intermix chamber 245 acting on intermix piston rods 228, 226, as well as pressure from fluid in the central bore of the tubing string acting on the actuator piston rods 216 and 218. As a result, the control passages 212 and 214 are sealed against passage of fluid into their respective control lines. In the embodiment depicted in FIG. 4A, the piston assemblies 422 and 424 employ metal-to-metal static-type seals: using metal components for direct contact with the upper sealing seats 413 and 415, which are made of metal. Metal-to-metal seals rely on two metal surfaces being brought together under pressure so that any gap remaining between the two surfaces becomes so small that there is no substantial leakage. Such metal-to-metal seal may endure high temperature and high pressure environments and achieve greater reliability than polymer seals. Although discussed here as a metal-to-metal seal, other types of seals could be used.

In actuated positions, the piston assemblies 422 and 424 seal against lower sealing seats 432 and 434 that are installed into the lower end of the piston housing 210, as illustrated in FIG. 3A where the piston assembly 422 is sealing against the lower sealing seat 432. The arrangement of the components is such that once the actuator piston rods 216 and 218 have compressed the power spring 225 and moved the flow tube 250 to open the flapper 234, the actuator piston rods 216 and 218 can be moved further to compress the spring 450 and accomplish the seal of the piston assemblies 422 and 424 with their respective sealing seats 432 and 434. In the embodiment depicted in FIG. 4A, the piston assemblies 422 may employ a metal-to-metal static seal that uses metal components for direct contact with metal components of the lower sealing seat 432. Although discussed here as metal-to-metal seals, other types of seals could be used.

Figure 4B:
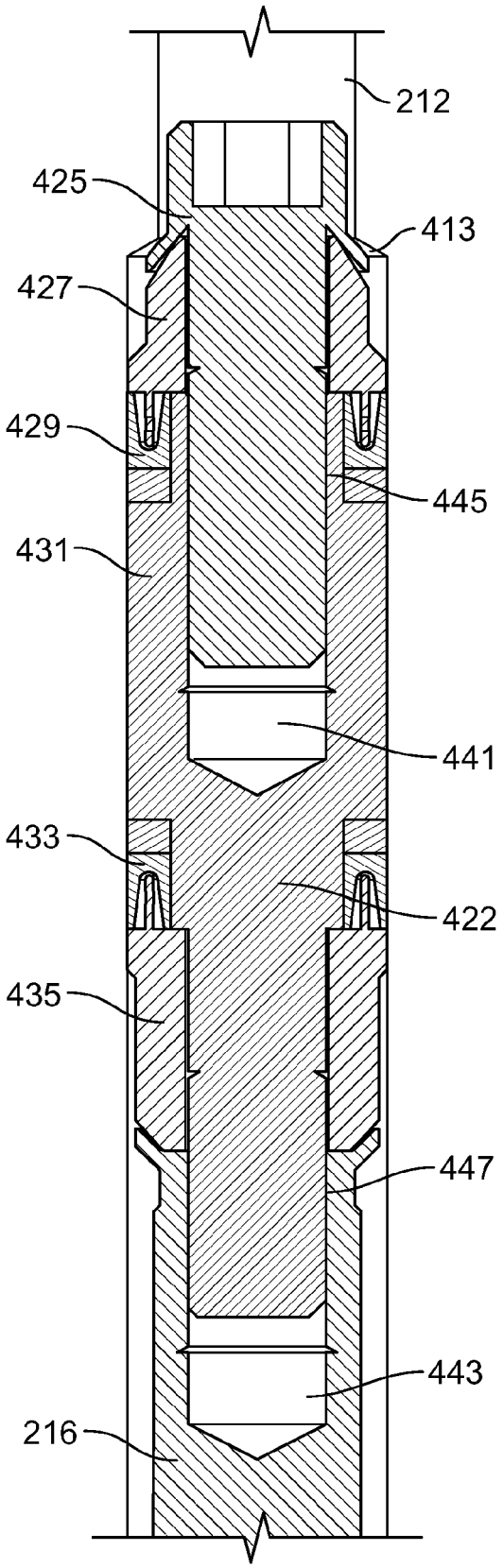
FIG. 4B is a detail half, side cross sectional view of the subsurface safety valve of FIG. 2 showing details of an actuator piston assembly.

FIG. 4B is a detail half, side cross sectional view of the subsurface safety valve 200 showing details of an actuator piston assembly 422. The actuator piston assembly 422 is symmetrically identical to the actuator piston assembly 424; however, in some implementations, minor modifications may be made. For example, if the two separate control paths are assigned a primary and a secondary role, the actuator piston assembly 422 may be different from the actuator piston assembly 424 in dimensions, materials, etc. In the current embodiment, the actuator piston assembly 422 is symmetrically identical to the actuator piston assembly 424.

The upper metal seal 425 forms a static metal-to-metal seal with the upper sealing seat 413 at the lower end of the control passage 212, and connects to the middle connector 431 by screw thread 445 received in a female thread 441. Similarly, the lower portion of the piston assembly 422 is the actuator piston rod 216. The upper end of the actuator piston rod 216 is a flange structure that forms a static metal-to-metal seal with the lower sealing seat 432 (FIG. 4A), and has an inner screw thread 443 to receive the middle connecter outer thread 447 and assemble with the middle connecter 431.

An upper hydraulic seal support 427 and a lower hydraulic seal support 435 are provided to support and locate an upper dynamic-type seal assembly 429 and a lower hydraulic dynamic-type seal assembly 433, respectively to seal with the sidewall of the piston cylinder. The dynamic-type seal assemblies 429, 433 are "dynamic" in that they are configured to seal against the wall of the piston cylinder while the piston is traversing the cylinder.

Figure 4C:
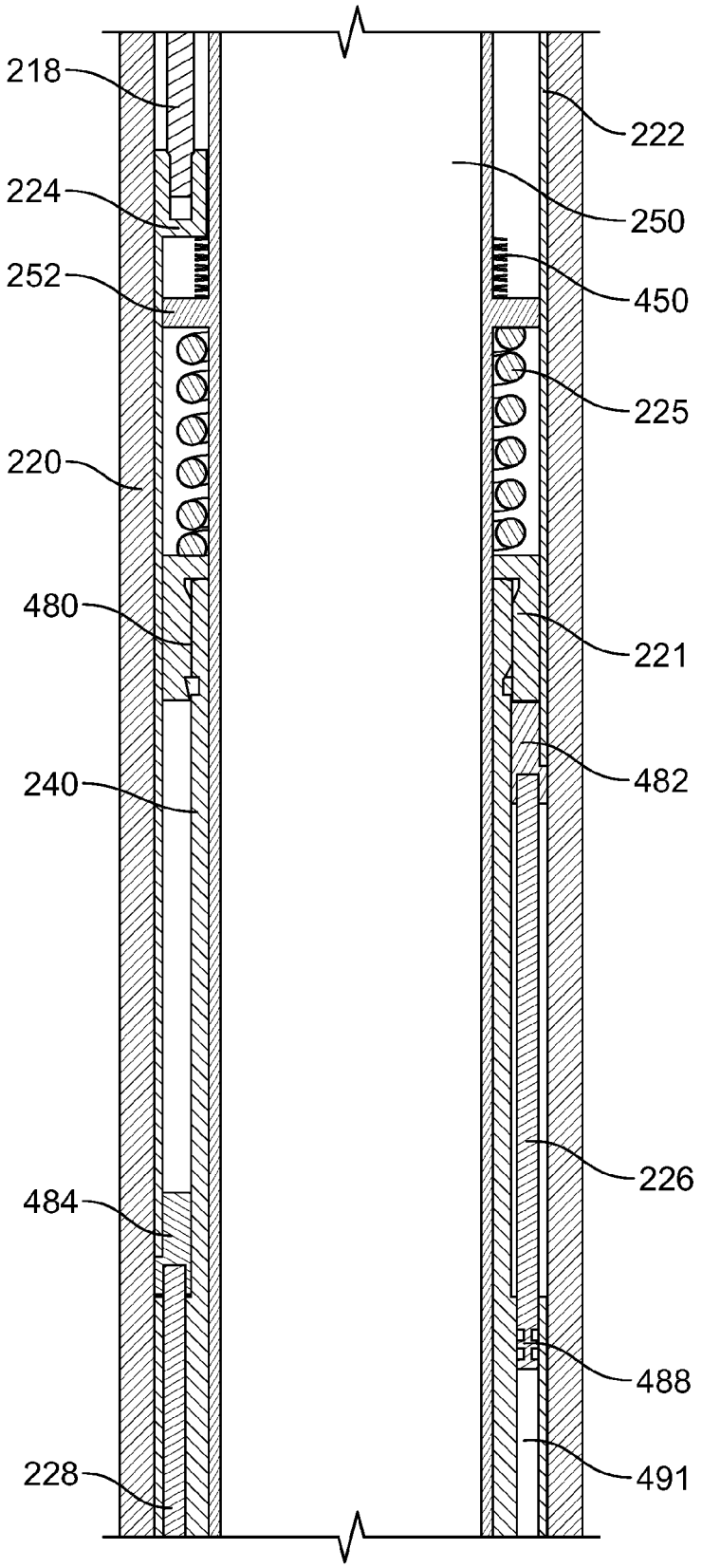
FIG. 4C is a detail half, side cross sectional view of the subsurface safety valve of FIG. 2 in the actuated position showing details of the intermix piston assemblies.

FIG. 4C is a detail half, side cross sectional view of the subsurface safety valve 200 in the actuated position showing details of the intermix piston assemblies. The intermix piston assembly of one control path may include the split actuator sleeve 222, the intermix piston rod sleeve 482, the intermix piston rod 226, and the inter mix piston 488. The split actuator sleeve 222 can translate up and down in the longitudinal direction of the flow tube 250, constrained by the inner wall of the spring housing 220 and the outer wall of the spring stop and bearing base 221. The spring stop and bearing base 221 is coupled with the intermix piston mandrel 240 using bearing base thread 480. The intermix piston mandrel 240 is further coupled with the spring housing 220 at the lower end using screw thread shown in FIG. 6. Therefore the spring stop and bearing base 221 is affixed to the spring housing 220 at a relatively permanent position.

FIG. 4C shows the control passage 214 pressurizing and actuating the actuator piston rod 218 to push down the flow tube 250 and the split actuator sleeve 224, the same as that of FIG. 3B. The split actuator sleeve 224 is coupled with the intermix piston rod sleeve 484 at a step created by diameter difference of the sleeve 484. The connection between the split actuator sleeve 224 and the intermix piston rod sleeve 484 may be keyed to prevent relative rotation. The intermix piston rod sleeve 484 is affixed to the intermix piston rod 228, translating downwards with the intermix piston 490 (shown in FIG. 5) and displacing hydraulic fluids to actuate the intermix piston 488 upwards.

The intermix pistons 488 and 490 may include a number of hydraulic seals inside the intermix cylinders 491 and 493 respectively. Each the intermix cylinders 491 and 493 may be connected with the intermix annular chamber 245 through a tubular passage with an opening diameter smaller than that of the intermix cylinders. The tubular passages serve as a travel stop for the intermix pistons 488 and 490.

Figure 5:
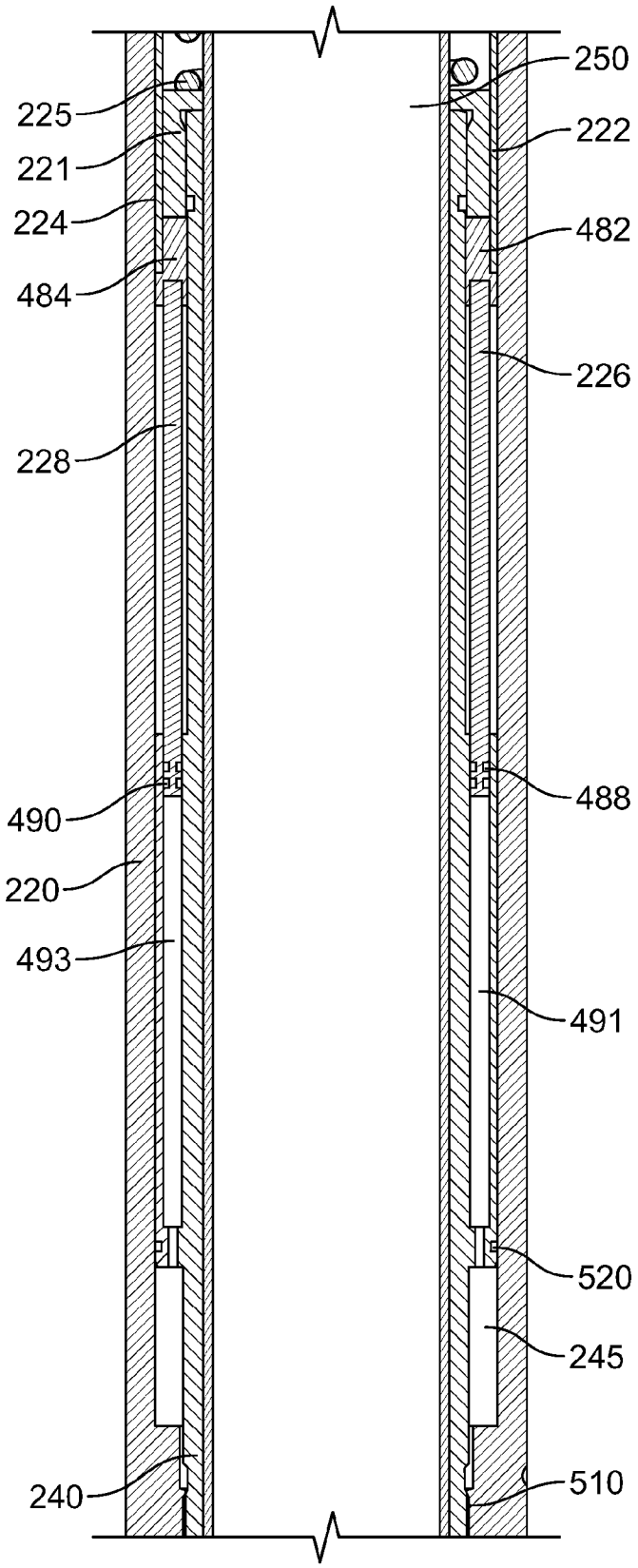
FIG. 5 is a detail half, side cross sectional view of the subsurface safety valve of FIG. 2 in the unactuated position showing details of intermix annular chamber.

FIG. 5 is a detail half, side cross sectional view of the subsurface safety valve 200 in the unactuated position showing details of intermix annular chamber 245. The intermix annular chamber 245 is formed from the enclosure of the outer surface of the intermix piston mandrel 240, the inner surface of the spring housing 220, the thread seal 510 connecting the intermix piston mandrel 240 and the spring housing 220, and the intermix piston housing seal 520. The intermix annular chamber 245 connects the intermix cylinder 491 with the intermix cylinder 493.

In an unactuated position as shown in FIG. 5, the intermix cylinders 491 and 493 and the intermix annular chamber 245 contain an incompressible or compressible hydraulic fluid (e.g., liquid). In certain instances, the hydraulic fluid is silicon oil. The chamber 245 can further contain a compressible fluid pressurized to a specified pressure that is above the expected downhole pressures to ensure any leakage will be directed from the chamber 245 outward and will avoid potential pollution of the hydraulic fluid from the well fluids and to cause the hydraulic fluid to operate as a liquid spring. The hydraulic fluid enables the intermix piston rods 226 and 228 to be responsively coupled with each other: when one is fully displaced to an actuated position, the other actuates the actuator piston rod 216 or 218 up to form a metal-to-metal seal with the control passages 212 or 214, respectively.

When the control passage 212 pressurizes and actuates the actuator piston rod 216 to push down the flow tube 250, the split actuator sleeve 222 is forced downwards as depicted in FIG. 3A. The split actuator sleeve 222 is coupled with the intermix piston rod sleeve 482 (shown in FIG. 4C) at a step created by diameter difference of the sleeve 482. The connection between the split actuator sleeve 222 and the intermix piston rod sleeve 482 may be keyed to prevent relative rotation. The intermix piston rod sleeve 482 is affixed to the intermix piston rod 226, translating downwards with the intermix piston 488 and displacing hydraulic fluids to actuate the intermix piston 490 upwards.

Figure 6:
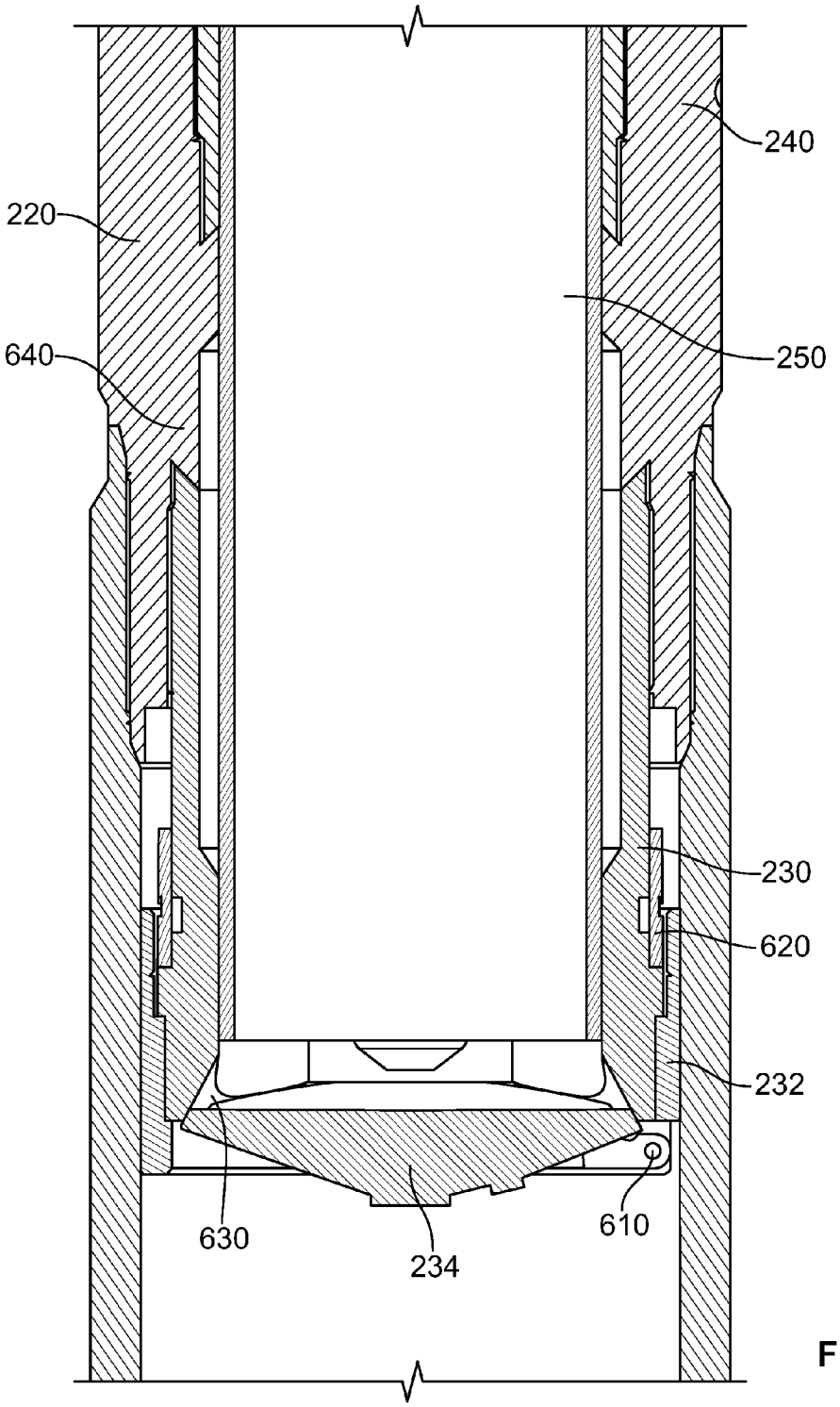
FIG. 6 is a detail half, side cross sectional view of the subsurface safety valve of FIG. 2 in the unactuated position showing details of flapper assembly.

FIG. 6 is a detail half, side cross sectional view of the subsurface safety valve 200 in the unactuated position showing details of flapper assembly. The flapper assembly includes the flapper 234, the flapper pin 610, the outer flapper carrier 232, the flapper seat joint, the inner flapper seat 230, and the flapper seal 630. The flapper 234 is biased closed with a spring carried about the flapper pin 610. The flapper pin 610 is assembled and affixed to the outer flapper carrier 232. The outer flapper carrier 232 maybe connected to the inner flapper seat 230 by screw thread and sealed with the flapper seat joint 620. The inner flapper seat 230 is assembled to the spring housing 220 by screw thread at the lower end of the spring housing 220. The upper circumferential end of the inner flapper seat 230 engages the guide 640 of the spring housing 220 and forms a seal. The flow tube 250 may apply downwards forces on the flapper 234 and cause the flapper 234 to rotate and open.

Figure 7:
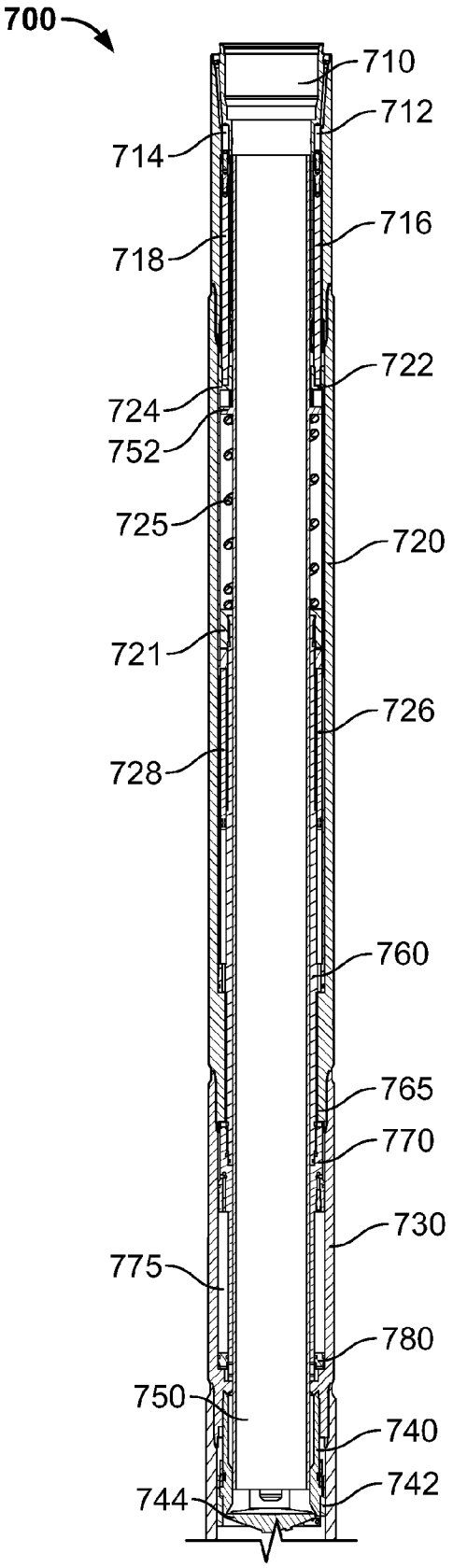
FIG. 7 is a half, side cross sectional view another example independent dual actuated subsurface safety valve in an unactuated position.

FIG. 7 is a half, side cross sectional view another example independent dual actuated subsurface safety valve 700 in an unactuated position. The subsurface safety valve 700 may be used as the subsurface safety valve 118 in FIG. 1. In this embodiment, the subsurface safety valve 700 includes a housing, actuation components, a float balancing piston 780 and chamber 775, a flow tube 750 and a flapper 744 as in the configuration of FIG. 2 above. Further elements that are similar to elements of subsurface safety valve 200 are similarly numbered with a 7XX prefix. However, the embodiment additionally includes a pressure balance chamber 775.

Figure 8:
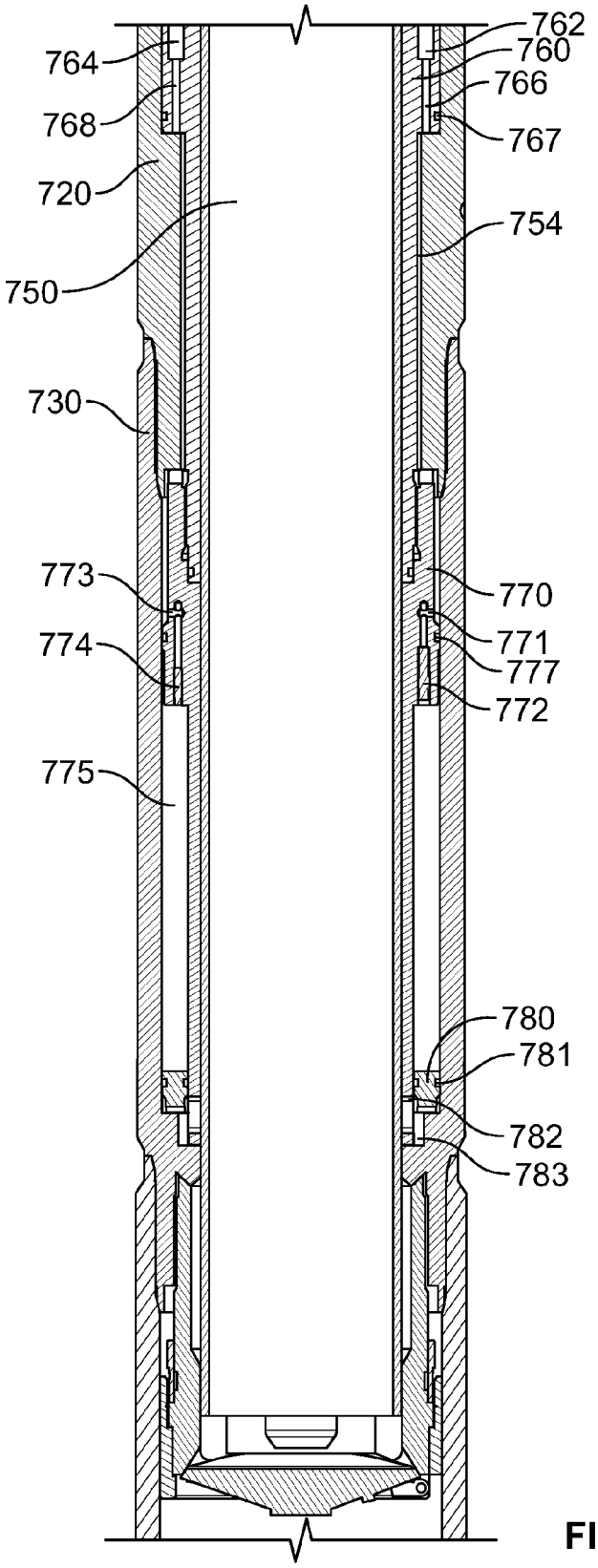
FIG. 8 is a detail half, side cross sectional view of the subsurface safety valve of FIG. 7 showing details of a pressure balance annular chamber.

FIG. 8 is a detail half, side cross sectional view of the subsurface safety valve 700 showing details of the pressure balance annular chamber 775. Unlike in the first embodiment where the subsurface safety valve 200 having the intermix annular chamber 245, the subsurface safety valve 700 includes the pressure balance annular chamber 775 filled with hydraulic fluid for the float balancing piston 780 that can respond to changes in pressure within the bore of the tubing string. The pressure in the pressure balance annular chamber 775 is balanced to this bore pressure, therefore compensating for variations of well and tubing string pressure and/or temperature fluctuations on the function of the subsurface safety valve 700.

The pressure balance annular chamber 775 functions similar to the intermix annular chamber 245 in that the intermix piston rod 726 is hydraulically linked with the intermix piston rod 728. The two intermix piston rods 726 and 728 are housed in the balanced intermix piston cylinders 762 and 764 respectively, each having a piston at the lower end for hydraulic sealing. The balanced intermix piston cylinders 762 and 764 are connected to the pressure balance annular chamber 775 via the balanced intermix flow passage 766 and 768, the intermix mandrel inner chamber 754, the pressure relief valve 772 and the check valve 774.

The intermix mandrel inner chamber 754 is enclosed by the outer surface of the balanced intermix piston housing 760, the inner surface of the spring housing 720, the intermix mandrel seal 767 and the inner balanced line housing 770. The clearance between the spring housing 220 and the inner balanced line housing 770 allows hydraulic fluids to flow between the intermix mandrel inner chamber 754 and the fluid ports in the inner balanced line housing 770. The inner balanced line housing 770 includes an overflow relief valve port 771 and a check valve port 773.

A check valve 774 and a pressure relief valve 772 are installed in the inner balanced line housing 770, respectively connected with the check valve port 773 and the relief valve port 771. The check valve 774 allows hydraulic fluid to pass in only one direction—from the pressure balance annular chamber 775 toward the intermix piston cylinders 762 and 764. The pressure relief valve 772 allows hydraulic fluid to pass from the intermix cylinders 762 and 764 to the pressure balance annular chamber 775 if the fluid pressure reaches and/or exceeds a specified pressure value. This enables the pressure in the pressure balance annular chamber 775 to fluctuate: if the pressure is lower than the pressure in the central bore of the tubing string, the check valve 774 allows the float balancing piston 780 to charge the pressure balance annular chamber 775; if the pressure exceeds the pressure in the central bore of the tubing string by a specified value, the pressure relief valve 772 allows hydraulic fluid to vent.

The float balancing piston 780 separates the pressure balance annular chamber 775 from the balanced flow chamber 783 keeping the hydraulic fluid separate from well fluids in the central bore of the tubing string. The pressure balance annular chamber 775 is connected to the check valve 774 and the pressure relief valve 772 as described above. The balanced flow chamber 783 is connected to the fluid in the central bore of the tubing string via a plurality of balanced flow pressure ports 782. The float balancing piston 780 has inner and outer float balancing piston seals 781. The float balancing piston 780 therefore can transmit pressure from either one of the chambers until a balanced position (i.e., static pressure balance between the fluids in the pressure balance annular chamber 775 and the fluid in the bore of the tubing string) is reached. That pressure is then communicated (as limited by the check valve 774 and pressure relief valve 772) to the intermix cylinders 762 and 764.

The specified value of the pressure relief valve 772 is selected to ensure that when one of the intermix piston rods 726 and 728 is compressed, sufficient pressure can be retained in the intermix cylinders 762 and 764 to overcome friction of the system and drive the other unactuated piston upwards without venting to the reservoir.

In addition, the pressure relief valve 772 ensures that the intermix cylinders 762 and 764 maintain a higher pressure than the pressure balance annular chamber 775. A higher pressure in the intermix cylinders 762 and 764 ensures long term slow leeching effects will not allow leakage of well fluids into the hydraulic fluid. The use of a pressure balance chamber 775 and the pressure relief valve 772 can result in a very low pressure differential at different sealing locations, further reducing long term leeching effect due to seal by-pass.

Notably, although the configurations described above are described with only two actuation systems, three or more actuation systems could be provided.

A number of embodiments have been described. Nevertheless, it will be understood that various modifications may be made. Accordingly, other embodiments are within the scope of the following claims.

What is claimed is:

1. A subsurface safety valve for use in a subterranean well, the valve comprising:

a tubular body defining a flow bore therethrough;

a closure in the tubular body, the closure changeable between sealing against flow through the flow bore and allowing flow through the flow bore;

a first piston having a first control line inlet arranged to receive a first control pressure from a first control line, the first piston movable from a first unactuated position to a first actuated position in response to the first control pressure;

a second piston having a second control line inlet arranged to receive a second control pressure from a second control line, the second piston moveable from a second unactuated position to a second actuated position in response to the second control pressure;

the first and second pistons coupled to the closure to change the closure between sealing against flow through the flow bore and allowing flow through the flow bore when the first and second pistons are respectively moved to the first and second actuated positions;

the first and second pistons hydraulically coupled to one another to support the first piston in an unactuated state when the second control pressure applied to the second piston is greater than an actuation pressure and the first control pressure applied to the first piston is less than the actuation pressure;

the first and second pistons are coupled to one another to support the first piston in an unactuated state when the second control pressure applied to the second piston is greater than the first control pressure applied to the first piston via a hydraulic fluid in a hydraulic fluid chamber of the valve; and the chamber is pressure balanced with the flow bore.

2. The subsurface safety valve of claim 1, wherein the first and second pistons are hydraulically coupled to one another to support the second piston in an unactuated state when the first control pressure applied to the first piston is greater than the actuation pressure and the second control pressure applied to the second piston is less than the actuation pressure.

3. The subsurface safety valve of claim 1, wherein the first piston comprises a static-type seal that seals against flow into the first control line when the first piston is in the first unactuated position.

4. The subsurface safety valve of claim 3, wherein the seal comprises a metal-to-metal seal.

5. The subsurface safety valve of claim 1, wherein the first piston comprises a static-type seal that seals against flow into the first control line when the first piston is in the first actuated position.

6. The subsurface safety valve of claim 5, wherein the static-type seal comprises a metal-to-metal seal and is in addition to a dynamic-type seal between the first piston and a sidewall of a cylinder containing the first piston.

7. The subsurface safety valve of claim 1, wherein moving the first piston from the unactuated position to the actuated position displaces hydraulic fluid in the hydraulic fluid chamber toward the second piston.

8. The subsurface safety valve of claim 1, wherein the chamber is open to pressure from the flow bore and the chamber comprises a piston isolating the hydraulic fluid from fluid of the flow bore.

9. The subsurface safety valve of claim 1, wherein chamber comprises a pressure relief valve arranged to maintain at least a specified pressure on the first and second pistons.

10. A method of operating a downhole valve, comprising:

receiving actuation pressure from a first control line at a first piston and from a second control line at a second piston and, in response to the actuation pressure, actuating a flow bore closure of the valve open using the first and second pistons, the first and second pistons coupled to one another via a hydraulic fluid in a hydraulic fluid chamber of the valve and the chamber being pressure balanced with the flow bore; and receiving reduced pressure below the actuation pressure from the second control line at the second piston and, in response to the reduced pressure, supporting the second piston with a hydraulic pressure created by the first piston, where supporting the second piston further comprises supporting the second piston to engage a static-type seal against passage of fluid with the second control line and wherein the static-type seal comprises a metal-to-metal seal.

11. A method of operating a downhole valve, comprising:

receiving actuation pressure from a first control line at a first piston and from a second control line at a second piston and, in response to the actuation pressure, actuating a flow bore closure of the valve open using the first and second pistons and in response to the actuation pressure, moving the first piston to engage a static-type seal against passage of fluid with the first control line, the first and second pistons coupled to one another via a hydraulic fluid in a hydraulic fluid chamber of the valve and the chamber being pressure balanced with the flow bore;

receiving reduced pressure below the actuation pressure from the second control line at the second piston and, in response to the reduced pressure, supporting the second piston with a hydraulic pressure created by the first piston, where supporting the second piston further comprises supporting the second piston to engage a static-type seal against passage of fluid with the second control line.

12. A method of operating a downhole valve, comprising:

receiving actuation pressure from a first control line at a first piston and from a second control line at a second piston and, in response to the actuation pressure, actuating a flow bore closure of the valve open using the first and second pistons, the first and second pistons coupled to one another via a hydraulic fluid in a hydraulic fluid chamber of the valve and the chamber being pressure balanced with the flow bore;

receiving reduced pressure below the actuation pressure from the second control line at the second piston and, in response to the reduced pressure, supporting the second piston with a hydraulic pressure created by the first piston; and receiving reduced pressure below the actuation pressure from the first control line at the first piston and, in response to the reduced pressure, allowing the flow bore closure of the valve to close.

13. A downhole valve for use in a well, comprising:

a closure device in a central bore of the valve and that is biased closed to seal against flow through the central bore;

a plurality of pistons each coupled to a respective hydraulic control line into the valve, each piston adapted to reside in an actuated position, supporting the closure open, when at least a specified hydraulic pressure is supplied through its control line, and to reside in an unactuated position, not supporting the closure open, when at least the specified hydraulic pressure is not present in its control line; and a chamber containing a hydraulic fluid hydraulically coupling the pistons to support any piston not receiving at least the specified hydraulic pressure in an unactuated position, the chamber being pressure balanced with the central bore.

14. The valve of claim 13, wherein when each piston is in the unactuated position, it seals against communication of fluid with its respective control line using a static-type seal.

15. The valve of claim 14, wherein the static-type seal is a metal-to-metal seal.

16. The valve of claim 13, wherein each piston is additionally supported in the unactuated position by a spring.

17. The valve of claim 13, wherein each piston is additionally supported in the unactuated position by pressure from the central bore of the valve.

18. The valve of claim 13, wherein when each piston is in the actuated position, it seals against communication of fluid with its respective control line using a static-type seal.

19. The valve of claim 18, wherein the static-type seal is a metal-to-metal seal.

* * * * *

UNITED STATES PATENT AND TRADEMARK OFFICE

CERTIFICATE OF CORRECTION

PATENT NO. : 9,206,670 B2
APPLICATION NO. : 13/632347
DATED : December 8, 2015
INVENTOR(S) : Andrew John Webber et al.

It is certified that error appears in the above-identified patent and that said Letters Patent is hereby corrected as shown below:

On the title page, item 65:

Column 1 (Domestic Priority Data), line 16, after "US 2013/00092396 A1 Apr. 18, 2013", insert -- Foreign Application Priority Data, Oct. 12, 2011 (WO) .....2011055960 --, therefor.

Signed and Sealed this
Fourteenth Day of June, 2016

Michelle K. Lee

Michelle K. Lee
*Director of the United States Patent and Trademark Office*